US005230451A

United States Patent [19]

Onozawa

[11] Patent Number: 5,230,451

[45] Date of Patent: Jul. 27, 1993

[54] HARNESS FOR NECK-WORN ARTICLES

[76] Inventor: Shoji Onozawa, 19152 SE. 51st St., Issaquah, Wash. 98027

[21] Appl. No.: 762,489

[22] Filed: Sep. 19, 1991

[51] Int. Cl.[5] ..... A45F 5/02

[52] U.S. Cl. ..... 224/194; 224/252; 224/908; 224/909; 224/202; 2/300; 24/302; 24/114; 24/3 R

[58] Field of Search ..... 224/150, 194, 202, 205, 224/209, 210, 252, 257, 258, 265, 266, 908, 909; 2/230, 300, 310–312, 338; 24/3 R, 3 B, 3 J, 3 L, 3 M, 114, 298, 300–302

[56] References Cited

U.S. PATENT DOCUMENTS

| | | | |
|---|---|---|---|
| 174,696 | 3/1876 | Metcalfe | 224/202 |
| 181,539 | 8/1876 | Reid | 2/300 |
| 202,394 | 4/1878 | Armstrong | 24/302 X |
| 421,519 | 2/1890 | Rosenstock | 2/300 |
| 763,519 | 6/1904 | Taylor et al. | 2/300 X |
| 780,630 | 1/1905 | Wittkopp | 224/194 X |
| 915,628 | 3/1909 | Seymore | 224/265 X |
| 1,252,221 | 1/1918 | Berman | 2/230 |
| 1,281,822 | 10/1918 | Orr | 224/266 X |
| 1,401,227 | 12/1921 | Wyeth | 24/301 X |
| 2,015,869 | 10/1935 | Pulz | 224/908 X |
| 2,350,339 | 6/1944 | Costa | 24/298 X |
| 2,658,435 | 11/1953 | Sarvoy | 2/300 |
| 3,184,883 | 5/1965 | McCook | 2/311 |
| 4,416,405 | 11/1983 | Caillouet | 224/257 |
| 4,561,576 | 12/1985 | Lowe et al. | 224/209 |
| 4,895,286 | 1/1990 | DeRosa | 224/265 |

FOREIGN PATENT DOCUMENTS

| | | | |
|---|---|---|---|
| 0504090 | 6/1920 | France | 2/300 |
| 0019970 | of 1890 | United Kingdom | 24/301 |
| 0028090 | of 1909 | United Kingdom | 24/302 |

OTHER PUBLICATIONS

Tamrac Catalog, X-Press Action Camera Harness (p. 30), 1991 Copyright date on catalog.

Popular Photography, Move Method Camera Belt (pp. 52–53), Dec., 1991.

*Primary Examiner*—Henry J. Recla
*Assistant Examiner*—Casey Jacyna
*Attorney, Agent, or Firm*—Graybeal Jackson Haley & Johnson

[57] ABSTRACT

A harness for securing a neck strap of a neck-worn article remote from the neck of the wearer is disclosed. The harness includes a padded band adapted for placement of the neck strap of the neck-worn article therethrough. The padded band includes a buckle for opening and closure thereof, and is adapted to be oriented adjacent to the back of the wearer such that the weight of the neck-worn article is borne and/or dispersed by the padded band. An elongate strap is attached to the padded band and includes a fastener for attaching the harness to the clothing of the wearer to secure the padded band while it bears the weight of the neck-worn article.

6 Claims, 2 Drawing Sheets

HARNESS FOR NECK-WORN ARTICLES

BACKGROUND OF THE INVENTION

The invention pertains to apparatuses for securing articles carried on the body, and more specifically to harnesses for securing neck straps of neck-worn articles remote from the wearer's neck.

Articles intermittently used by individuals with short notice, such as still and video cameras, binoculars, portable sketch and drafting boards and the like, are generally worn around the neck for convenience. These articles are often complex devices that are heavy. The neck strap employed to hang these articles around the wearer's neck concentrates the weight of the article on the back of the neck, resulting in neck strain and skin chafing and abrasions.

A need thus exists for a harness for securing neck-worn articles remote from the wearer's neck to prevent neck strain and injury in which the harness is compact and convenient to use.

SUMMARY OF THE INVENTION

In accordance with the invention, a harness for securing a neck strap of a neck-worn article remote from the neck of the wearer is provided. The harness includes a padded band adapted for placement of the neck strap of the neck-worn article therethrough. The padded band has a band fastener for opening the padded band for placement of the neck strap therein, and for closing the padded band to hold the neck strap therein. The padded band is adapted to be oriented adjacent to the neck and/or back of the wearer such that the weight of the neck-worn article is borne and/or dispersed by the padded band.

An elongate strap is attached to the padded band and includes a fastener for attaching the harness to the clothing of the wearer to secure the padded band while it bears the weight of the neck-worn article.

In one embodiment of the present invention, the elongate strap is Y-shaped and adjustable. Each of the two arms of the Y-shaped elongate strap has a clothing fastening clip on its end for attachment of the harness to the clothing of the wearer to secure the padded band while it bears the weight of the neck-worn article. The Y-shaped elongate strap also has a base section attached to the padded band by a ring that allows movement of the padded band relative to the elongate Y-shaped strap.

Alternatively, the elongate strap can be of a shape other than Y-shaped, such as, for example, linear. More or less than two clothing fasteners must also be present, and the clothing fasteners may be velcro-type, sewn thread, hooks, snaps, and/or buttons. Also, the padded band can be secured directly to the user's clothing or accessories such as backpacks or the like without employing an elongate strap. Instead of a padded band, a non-padded band, a hook or a ring may be attached to the elongate strap to the clothing fasteners.

BRIEF DESCRIPTION OF THE DRAWINGS

The foregoing objects and most of the attendant advantages of this invention will become more readily appreciated as the same becomes better understood by reference to the following detailed description when taken in conjunction with the accompanying drawings wherein.

DETAILED DESCRIPTION OF THE PREFERRED EMBODIMENTS

Figure 1:
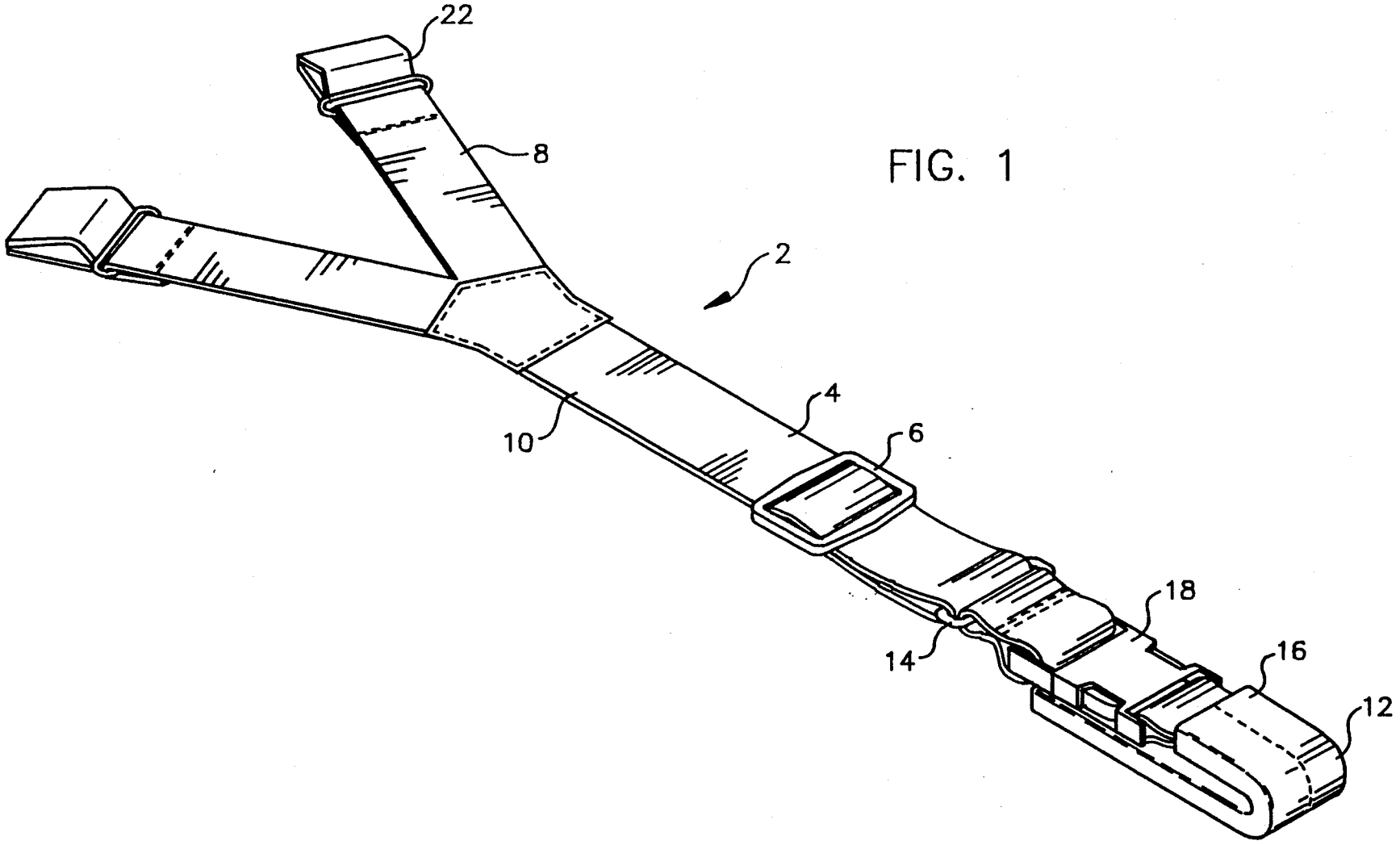
FIG. 1 is an isometric view of a harness for neck-worn articles representative of the present invention.
Figure 2:
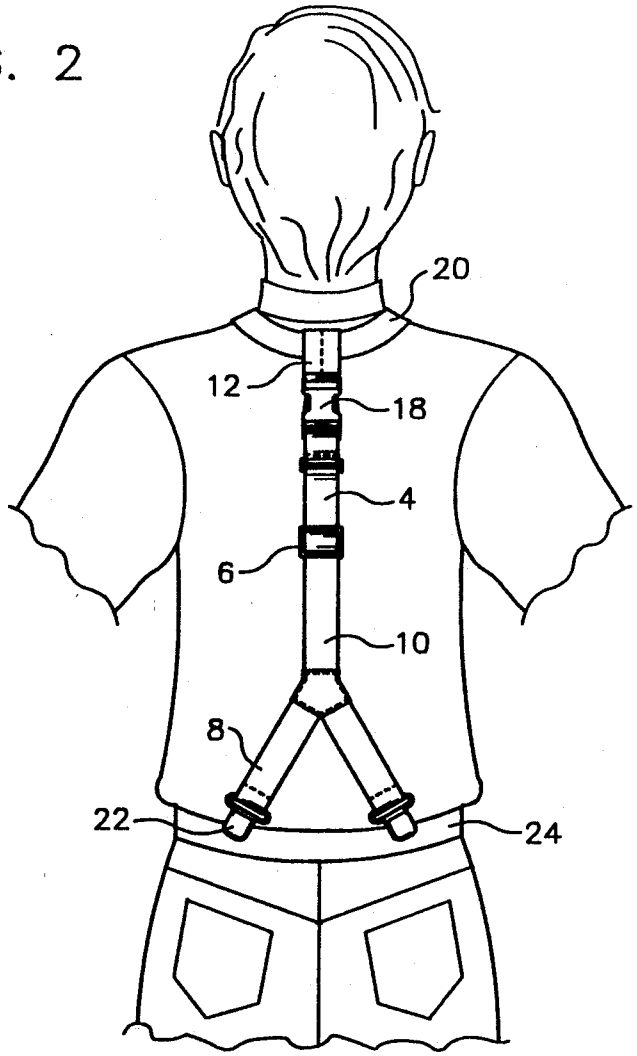
FIG. 2 is a plan of the harness of FIG. 1 in use.

Referring to FIGS. 1 and 2, the first embodiment of the present invention is shown. Harness 2 includes elongate strap 4 which preferably includes buckle 6, which allows adjustment of the length of elongate strap 4. Elongate strap 4 is preferably comprised of either synthetic or natural fabric such as plastic or leather, for example. While elongate strap 4 is preferably Y-shaped, other configurations of elongate strap 4 are contemplated within the scope of the invention. For example, elongate strap 4 can also be substantially linear.

The Y-shaped configuration of elongate strap 4 includes two arms 8 integral with a base section 10. Base section 10 is interconnected with band 12 by ring 14. Ring 14 allows relative pivotal and lateral movement of band 12 relative to elongate strap 4.

Band 12 is preferably comprised of a synthetic or natural fabric such as plastic or leather, for example, with a padded portion 16 adapted to rest against the back and/or the back of the neck of the wearer. Note that this padded portion 16 is optional. Band 12 preferably includes a band fastener 18 that allows opening of band 12 for placement of neck strap 20 of the neck-worn article therethrough. Closure of band fastener 18 secures neck strap 20 in band 12. Band fastener 18 is preferably a buckle, but may also be, for example, a velcro-type fastener, a snap, hook, ring, or a button. It is also to be noted that while the preferred embodiment of the present invention employs a band 12, a hook or ring attached to elongate strap 4 is also contemplated within the scope of the present invention, as is any other yoke-type means for securing the strap of a neck-worn article.

Each of arms 8 of elongate strap 4 include a clothing fastener 22 on an end thereof. Clothing fastener 22 is preferably a clip but may also be, for example, a velcro fastener, sewn thread, a hook, a snap or a button.

Now referring specifically to FIG. 2, the operation of the first embodiment of the present invention is discussed. Clothing fasteners 22 are secured to clothing 24 of the user of the neck-worn article. Clothing fasteners 22 are shown, in FIG. 2, attached to pants. However, clothing fasteners 22 may be secured, for example, to the shirt or jacket of the user, as discussed below. The length of elongate strap 4 can, at this time or prior to attachment of clothing fasteners 22 to clothing 24, be adjusted by means of buckle 6. Elongate strap 4 is preferably adjusted to a length such that band 12 is oriented at, or just below, the neck of the wearer adjacent to the back of the wearer. In this orientation, padded portion 16 of band 12 preferably lies flat against the back and/or neck of the wearer. Band fastener 18 can, at this time or prior to attachment of clothing fasteners 22 and/or adjustment of the length of elongate strap 4, be opened for placement of neck strap 20 in band 12. Closure of band fastener 18 secures neck strap 20 in band 12. Upon completion of the above steps, harness 2 is configured to bear and/or disperse the weight of the article (not shown, but for example a camera or binoculars) hanging from the user's neck due to the location of band 12 between strap 20 and the back and/or neck of the wearer. Elongate strap 4, by attachment to clothing 24 by means of clothing fasteners 22, secures band 12 while it bears and/or disperses the weight of the neck-worn article.

Figure 3:
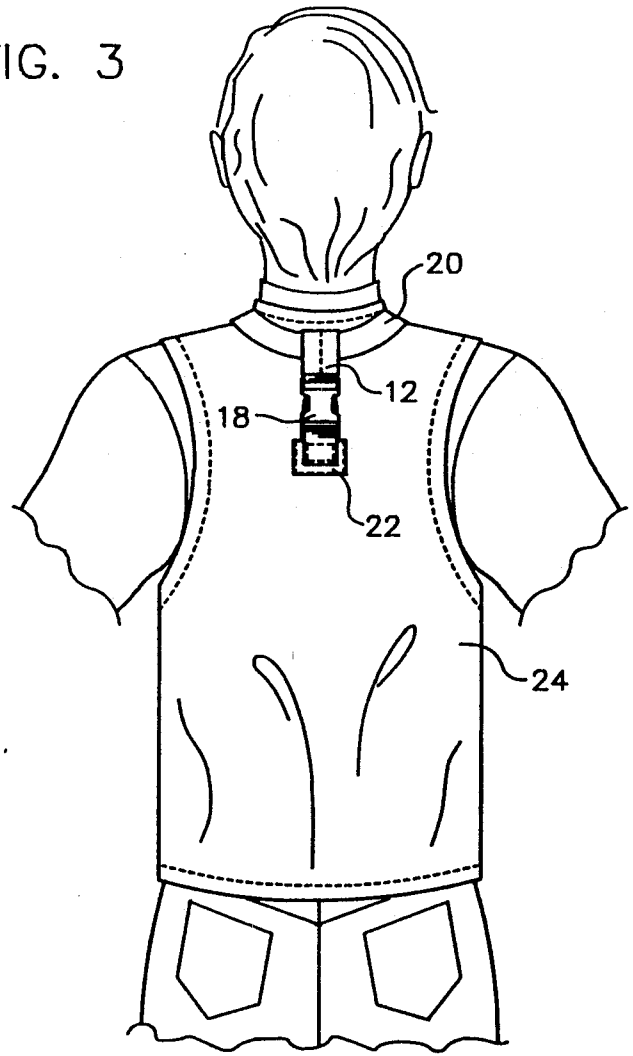
FIG. 3 is a plan view of an exemplary alternate embodiment of the harness in use.

Referring now to FIG. 3, an alternate embodiment of the present invention is shown. The element numbers in FIG. 3 that are the same as those in FIGS. 1 and 2 denote common elements. FIG. 3 shows an embodiment of the present invention in which harness 2 is secured to clothing 24 such as a jacket, vest or shirt, or an accessory such as a backpack, as opposed to the embodiment of FIGS. 1 and 2 in which harness 2 was attached to clothing 24 such as pants. Due to the closer proximity of a jacket, vest or shirt to harness 22 when compared to pants or the like, elongate strap may be much shorter in the embodiment shown in FIG. 3. Alternatively, elongate strap 4 may be entirely absent in this embodiment, with clothing fastener 22 being directly attached to band 12 instead. The embodiment of FIG. 3 shows clothing fastener 22 being a velcro-type attachment. However, sewn thread, snaps or buttons may also be employed, for example.

While preferred embodiments of the invention have been illustrated and described, it will be appreciated that various changes can be made therein without departing from the spirit and scope of the invention.

I claim:

1. A harness for securing a neck strap of a neck-worn article remote from the neck of a wearer, said harness comprising:

a padded band adapted for placement of the neck strap of a neck-worn article therethrough, said padded band having a band fastening means for opening said padded band for placement of a neck strap therein, and for closing said padded band for holding a neck strap therein, said padded band adapted to be oriented adjacent the back of the wearer such that the weight of the neck-worn article is borne by said padded band;

a y-shaped elongate strap having an end attached to said padded band and two arms remote from said padded band; and a clothing fastening means on each of said elongate strap arms for attaching said harness to clothing of the wearer to secure said padded band while said padded band bears the weight of the neck-worn article.

2. The harness of claim 1 wherein said padded band is attached to said elongate strap by a ring, said ring allowing movement of said padded band relative to said elongate strap.

3. The harness of claim 1 wherein said padded band fastening means is a buckle.

4. The harness of claim 1 wherein said clothing fastening means is a clip.

5. The harness of claim 1 wherein said elongate strap is adjustable in length.

6. A harness for securing a neck strap of a neck-worn article remote from the neck of a wearer, said harness comprising:

a padded band adapted for placement of the neck strap of a neck-worn article therethrough, said padded band having a buckle for opening said padded band for placement of a neck strap therein and for closing said padded band for holding a neck strap therein, said padded band adapted to be oriented adjacent the back of the wearer such that the weight of the neck-worn article is borne by said padded band;

an elongate, adjustable Y-shaped strap having a base section attached to said padded band and having two arms with a clothing fastening clip on each of said arms, said clothing fastening clips attaching said harness to clothing of the wearer to secure said padded band while said padded band bears the weight of the neck-worn article; and a ring attaching said padded band to said base section of said elongate, adjustable Y-shaped strap, said ring allowing movement of said padded band relative to said elongate, adjustable Y-shaped strap.

* * * * *